US005499073A

United States Patent [19]

Pummell

[11] Patent Number: 5,499,073

[45] Date of Patent: Mar. 12, 1996

[54] PROCESSING APPARATUS

[75] Inventor: Leslie J. H. Pummell, Rickmansworth, England

[73] Assignee: Eastman Kodak Company, Rochester, N.Y.

[21] Appl. No.: 390,330

[22] Filed: Feb. 17, 1995

[30] Foreign Application Priority Data

Feb. 23, 1994 [GB] United Kingdom ..... 94003416

[51] Int. Cl.[6] ..... G03D 3/08; G03D 13/08

[52] U.S. Cl. ..... 354/320; 354/322; 354/339; 271/226; 271/184; 271/185; 226/109; 226/110

[58] Field of Search ..... 354/319–324, 354/331, 336, 337, 339; 134/64 P, 64 R, 122 P, 122 R; 355/27–29; 226/109, 110; 271/226, 184, 185

[56] References Cited

U.S. PATENT DOCUMENTS

| | | | |
|---|---|---|---|
| 4,164,371 | 8/1979 | Viehrig et al. | 354/319 X |
| 4,416,529 | 11/1983 | Kastl | 354/320 |
| 4,464,035 | 8/1984 | Schoering | 354/322 X |
| 4,708,453 | 11/1987 | Fryda et al. | 354/320 |
| 4,760,417 | 7/1988 | Zwettler | 354/322 X |
| 4,903,064 | 2/1990 | Kogane et al. | 354/321 |
| 5,241,336 | 8/1993 | Glover et al. | 354/322 X |
| 5,327,189 | 7/1994 | Wernicke et al. | 354/324 |

*Primary Examiner*—D. Rutledge
*Attorney, Agent, or Firm*—Frank Pincelli

[57] ABSTRACT

A processing apparatus for processing a web-like item such as a photographic film comprises a plurality of processing stations (2,3,4,5) and means (16,17,18,19) for conveying the web-like item through the apparatus along a predetermined path between the processing stations (2,3,4,5). Opposed regions of the apparatus define channels (13,14) which receive opposed longitudinal edges of the web-like item, the channels (13,14) defining the predetermined path. At least part (30) of each channel is defined by elements (27) releasably mounted upon the apparatus, the releasable mounting of the elements (27) on the apparatus permitting ready removal of the elements (27) and replacement by different elements (27) in order to vary the predetermined path along which the web-like item is conveyed as it passes through the apparatus.

10 Claims, 3 Drawing Sheets

PROCESSING APPARATUS

FIELD OF THE INVENTION

The present invention relates to a processing apparatus and more particularly to a processing apparatus incorporating a plurality of processing stations and a conveyor guide for guiding a web of material along a pre-determined path as it passes between various processing stations. The processing apparatus of the present invention is particularly suitable for the processing of webs of photographic material but is not limited to use in this one application and may, for example, be used in the processing of paper, textiles and similar web-like materials.

BACKGROUND OF THE INVENTION

During the processing of photographic material the material passes through various processing stages, such as a developing stage, a fixing stage, a washing stage and a drying stage. In many of these stages the material is immersed in a processing solution. Different processing solutions are required in order to process different types of photographic material. Thus, for example, a developing solution which is suitable for the development of color photographic film may not be suitable for developing black and white film. Similarly a different fixing solution may be required for the different types of film. It will therefore be appreciated that if a photographic processing apparatus incorporates a single tank for receiving the developing solution and a single tank for receiving the fixing solution, then it will be necessary to empty and re-fill each of the tanks with appropriate solution whenever a different type of photographic material is to be processed in the apparatus. Clearly this is inconvenient and time consuming and involves the repeated handling of processing solutions which can in some cases be hazardous and require careful handling.

In a photographic processing apparatus of this type it is known to guide a length or web of film or paper in grooves which define a predetermined path to be followed by the film or paper. Thus, opposed longitudinal edges of a web of film or paper will be received within opposed grooves formed in walls located on opposite sides of the processing apparatus, the walls typically being formed of a plastics material. The web is conveyed along the path defined by the grooves by way of appropriate drive rollers or the like. While this arrangement represents a simple and effective way of guiding the web of film or paper along a predetermined path, it is designed for situations where the web of material is to be conveyed sequentially from one processing tank to another and once a processing apparatus has been constructed with this type of conveying/guide means, a fixed path is defined along which the web of material must pass.

Such an arrangement does not allow for variation of the path to be followed and would not therefore enable, for example, one particular processing tank to be bypassed. Another problem which arises with an apparatus constructed in this way is that those parts of the grooves which are located outside of the processing solutions can become contaminated with crystalline deposits or oxidized chemicals and with existing designs it is particularly difficult thoroughly to clean these sections of the path defined by the grooves.

The present invention seeks to provide an improved processing apparatus, particularly, but not exclusively, one which is suitable for use in processing a web of photographic material and which addresses the points discussed above.

SUMMARY OF THE INVENTION

According to the present invention there is provided a processing apparatus for processing a web-like item, said apparatus comprising a plurality of processing stations and means for conveying the web-like item through the apparatus along a predetermined path between the processing stations, the apparatus having opposed regions defining channels which receive opposed longitudinal edges of the web-like item, the channels defining said predetermined path, part of each channel being defined by elements releasably mountable upon the apparatus, the releasable mounting of the elements on the apparatus permitting ready removal of one set of elements and replacement by a different set of elements which define a different predetermined path along which the web-like item is conveyed as it passes through the apparatus.

Preferably said part of each channel is defined by the edges of plates constituting the said elements, the plates being releasably mounted upon a planar surface within said opposed regions of the apparatus.

The plates may be mounted directly upon the apparatus or may be mounted upon a supporting substrate which is in turn releasably mounted upon the apparatus.

Conveniently the plates on opposite sides of said part of the channel are formed of different materials.

A first plate on one side of the channel may be formed of glass and a second plate on the other side of the channel may formed of polytetrafluoroethylene.

Advantageously said part of the channels which are defined by elements releasably mounted upon the apparatus are disposed at the junction between adjacent processing stations, the arrangement being such that appropriate selection of the elements mounted upon the apparatus enables the predetermined path either to pass through a processing station or to bypass the processing station.

The elements may define two possible paths which may be followed by the web-like item and a switching arrangement may be associated with the elements, the switching arrangement including a movable element which moves between two positions and establishes a route along a first path when in a first position and establishes a route along a second path when in a second position.

The apparatus may comprise a photographic processing apparatus.

This invention also provides an apparatus as described above in combination with a kit of said elements adapted to be releasably mounted on the apparatus, the kit comprising elements of differing shape which define different paths through the apparatus when mounted thereon.

In order that the present invention may be more readily understood and so that further features thereof may be appreciated, the invention will now be described by way of example with reference to the accompanying drawings.

DETAILED DESCRIPTION OF THE INVENTION

Figure 1:
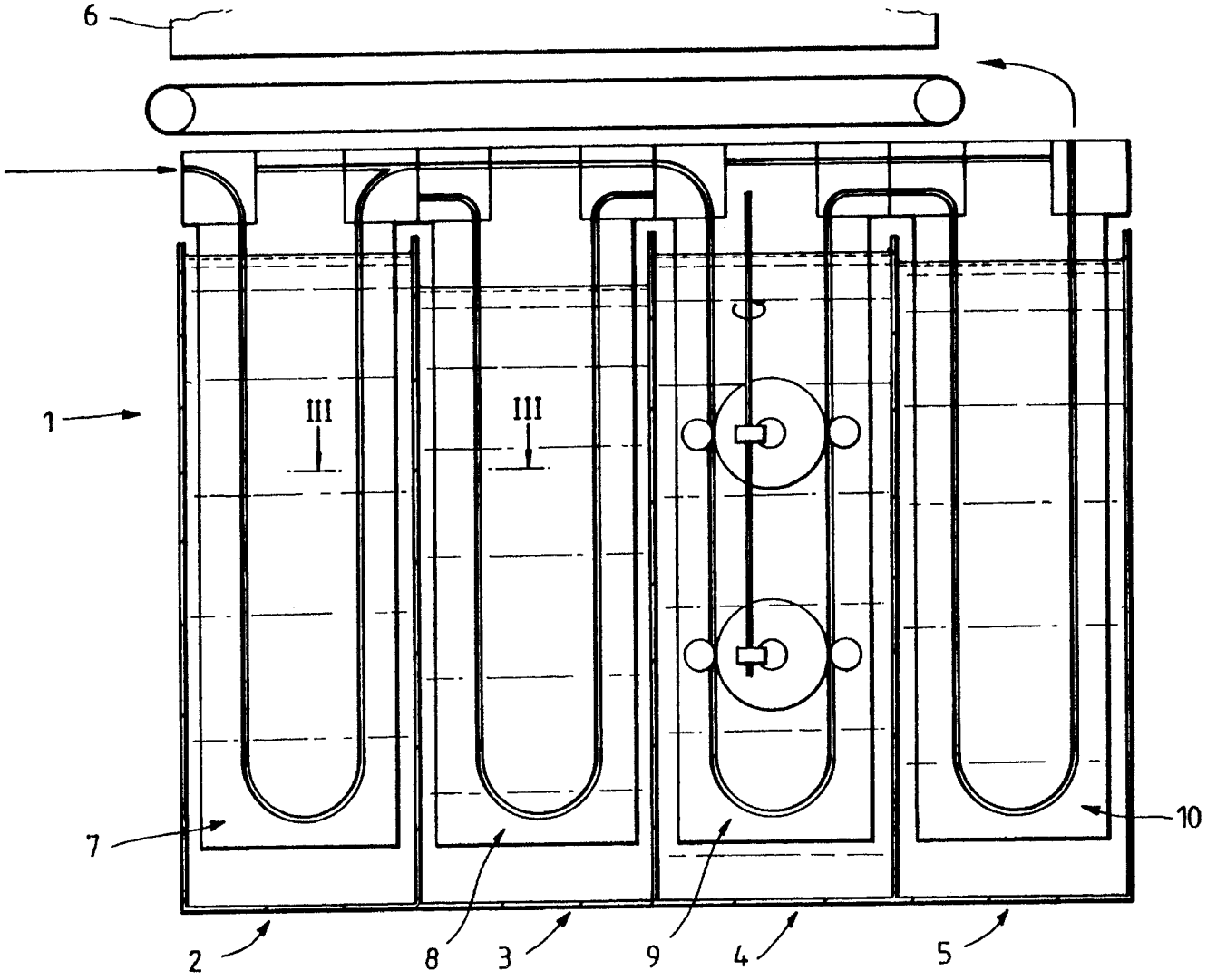
FIG. 1 is a schematic illustration of one embodiment of a processing apparatus in accordance with this invention.

Referring initially to FIG. 1 of the accompanying drawings, a photographic processing apparatus 1 comprises a plurality of processing stations constituted by juxtaposed processing tanks 2,3,4,5. Each processing tank is filled with a different processing solution, such as a photographic developer, bleach, fixer or the like. In use a strip of photographic film is conveyed through the apparatus 1, passing through various of the processing solutions in a predetermined sequence before passing to a drying unit 6 located above the processing tanks.

Each processing station is substantially identical, comprising its processing tank and an associated "rack". Thus, there are racks 7,8,9,10 associated with respective processing tanks 2,3,4,5. Each "rack" is identical and the basic rack is illustrated schematically in FIG. 2 of the drawings, with FIG. 3 showing a cross-section of part of the racks in two adjacent processing tanks. The rack comprises a pair of opposed walls 11,12 which are supported in a parallel, spaced-apart relation. The internal surfaces of the walls 11,12 define opposed grooves or channels 13,14 within which the opposed longitudinal edges of a strip of photographic film 15 (shown in dotted lines in FIG. 3) are received. The grooves 13,14 in each opposed wall 11,12 serve to define a generally U-shaped path extending down one side of the rack from an upper region thereof, around the bottom of the rack and back up the other side towards the upper end thereof. The strip of photographic film 15 is conveyed along the path defined by the grooves 13,14 so as to be carried through a processing solution received within the tank in which the rack is located.

Figure 2:
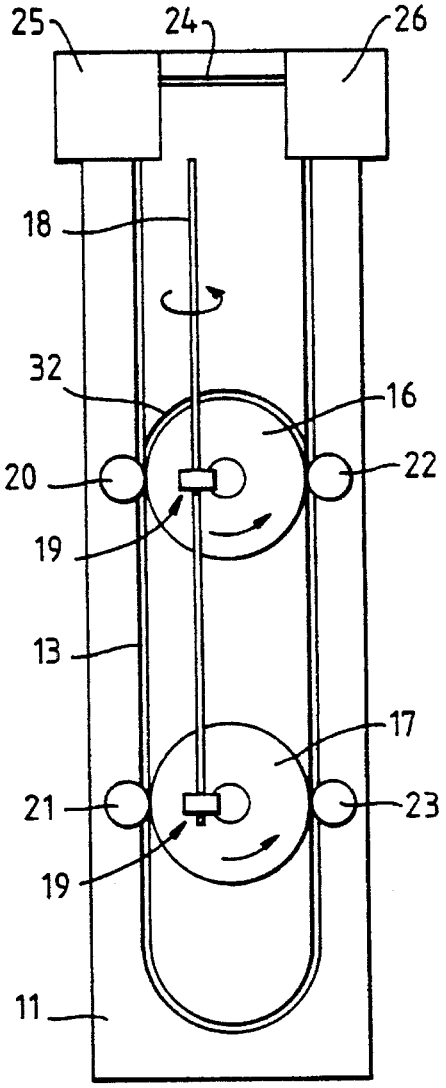
FIG. 2 is an enlarged view showing one section of the processing apparatus of FIG. 1.
Figure 3:
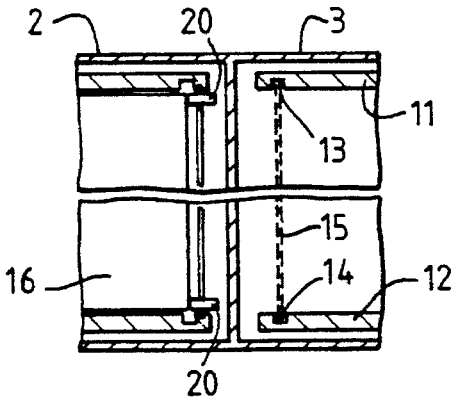
FIG. 3 is a cross-sectional view taken on the lines III—III of FIG. 1.

Appropriate means are provided for conveying the photographic film along the path defined by the grooves 13,14 and one possible arrangement of such conveying means is shown in FIG. 2. The conveying means may comprise rollers 16,17 which are driven by a shaft 18 provided with appropriate worm connections 19 to each of the rollers 16,17. The rollers 16,17 engage the rear surface of the strip of photographic film 15 while driven rollers 20,21,22,23 engage the front of the strip of film in its edge regions, there being a pair of opposed rollers 20, a pair of opposed rollers 21, etc. at each position adjacent the drive rollers 16,17. The drive rollers 16,17 are dimensioned so as simultaneously to engage the rear surface of the strip of film as it passes along the downwards path defined by the grooves on one side of the rack and as it passes along the upwards path defined by the grooves on the other side of the rack.

It is to be appreciated that although only one of the racks in FIG. 1 has been shown as having the conveying means described above, each rack is provided with such means. In addition, FIG. 3 only illustrates the drive roller 16 and driven rollers 20 between the opposed walls of one rack but this is, of course, only for the purposes of illustration and each rack is, as mentioned above, formed identically.

In addition to the grooves 13,14 the inwardly directed surface of each wall 11,12 is formed with a horizontal groove or channel 24 extending adjacent the upper end of the rack between opposed corner regions thereof. The horizontal groove 24 forms part of a "bypass" path, as will be explained in more detail below.

Furthermore, the inwardly directed surface of each wall 11,12 may define an additional track or channel 32 which extends arcuately around the top half of the upper roller 16 so as to interconnect the two opposed parts of the generally U-shaped path defined by the grooves 13,14 in each rack. The curved track or groove 32 serves to complete a loop in the lower region of the rack so that in use a film which is being processed can be cycled around this loop several times byway of an appropriate switching arrangement provided to divert the film around the track 32. In this way the film can remain completely immersed in a processing solution for an extended period of time by cycling it around the loop for as many times as are required. When the film is to be transferred to the next processing station, the switching arrangement is set so that the film does not pass along the track 32 but passes straight up and out of the rack.

As can readily be appreciated from FIG. 1 of the drawings, when the racks 7,8,9,10 are positioned in their respective processing tanks 2,3,4,5 the upper ends of the racks abut each other in such a way that the racks can define a continuous path from one processing tank to the next. As mentioned above, in a conventional photographic processing apparatus the photographic material would normally be conveyed through the apparatus so as to pass directly from one processing tank into the next tank. With the present invention it is possible to vary the route followed by the photographic material so that, if desired, the material may bypass selected processing tanks. This is achieved by the design of the upper region of the rack in each processing tank.

At its upper end the internal surface of each wall 11,12 of each rack defines opposed corner regions 25,26, the corner region 25 representing an inlet area to the path defined by the grooves 13,14 and the corner region 26 representing an outlet area from the path defined by the grooves 13,14. Each of the corner regions 25,26 define a planar surface for receiving inserts or elements which serve to form a continuation of the U-shaped groove defined in the walls of the rack, this continuation of the groove forming a link with the next adjacent rack and dictating the route which is followed by the web of photographic material. Different shaped inserts or elements can be used to define different routes. The photographic material may, for example, be guided from one processing tank into the processing solution in the next adjacent tank or may, alternatively, be guided along a "bypass" path across the top of the next adjacent tank before being transferred into the processing solution in the next but one processing tank.

Figure 4:
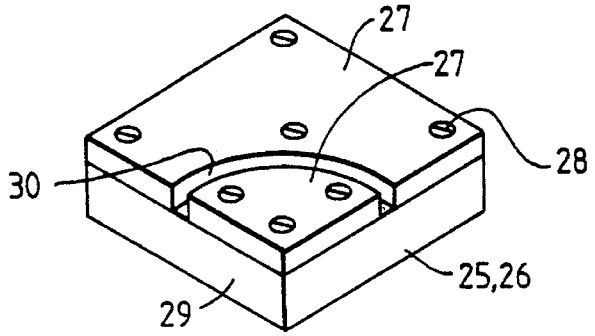
FIG. 4 is an enlarged perspective view showing one part of one section of the processing apparatus, such as the section shown in FIG. 2.

FIG. 4 illustrates one possible arrangement of elements for mounting in a corner region of one of the racks. The elements which serve to define the extension of the groove 13 or 14 comprise plates or substantially planar elements 27 designed to be received in the corner regions 25,26. The plates 27 may be screw-mounted within a shallow recess formed by the corner regions 25,26 by means of fixing screws 28 or may, alternatively, be fixed onto a supporting substrate 29 which is in turn mounted within recesses defined by the corner regions 25,26. If the plates 27 are initially mounted on a supporting substrate 29 then the assembled unit consisting of the plates and the supporting substrate may be located within a corner region of a rack as a snap-fitting connection, thereby avoiding the need to use tools in order to insert the plates in position upon the rack. It is envisaged that this may be simpler than trying to locate the plates 27 in position in the corner regions 25,26 on the rack directly.

In the arrangement shown in FIG. 4, two plates 27 are used to define a groove 30, each plate having a machined edge which is spaced from a correspondingly configured machined edge of the other plate so as to define the edges of the groove 30. The plates are, of course, designed and positioned relative to each other such that the groove 30 is of the same cross-section as the grooves 13,14 in the opposed walls of the rack, thereby ensuring that when the plates are positioned upon the rack, the groove 30 joins with the grooves 13,14 in order to form a single, continuous groove.

In FIG. 1 of the drawings an arrangement as shown in FIG. 4 is provided at the inlet to the rack 7 in the first processing tank 2. It will be appreciated that various different shapes of plates 27 can be used in order to define grooves extending in different directions. It is envisaged that the racks will enable a strip of photographic film to follow either a high level entry and exit path or a low level entry and exit path. The inlet to the grooves in the first rack 7 of FIG. 1 are at a high level which is aligned with the groove 24 near the top of the rack. It will be appreciated that the arrangement shown in FIG. 4 is for use in guiding a photographic film into a rack from a high level inlet. The low level entry or exit path would, of course, be positioned at a lower level.

Figure 5:
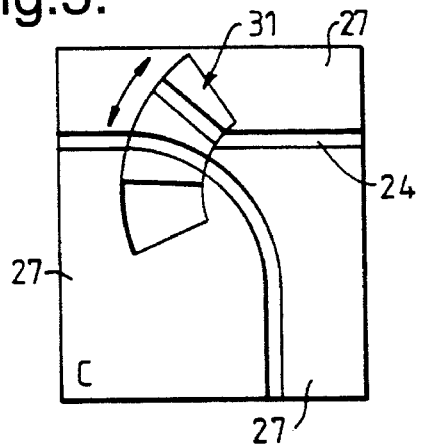
FIGS. 5 to 9 are side views of different embodiments of the part shown in FIG. 4.

Other arrangements of plates are shown in FIGS. 5 to 9. The high level path may be used in order to convey the photographic film passed one of the processing tanks. FIG. 5 shows a routing arrangement in which three plates 27 are provided, the plates defining an inlet to a rack from a high level with an option to switch the inlet along a high level bypass path. Thus, this particular arrangement incorporates a switch 31 movable between two discrete positions, one position producing a channel or groove which would convey a web of film down into a rack, the other position producing a horizontal channel or groove which would convey the film along a high level bypass path, formed, in part, by the groove 24. The switch 31 may take forms other than that illustrated and may be actuated by any appropriate means.

Figure 6:
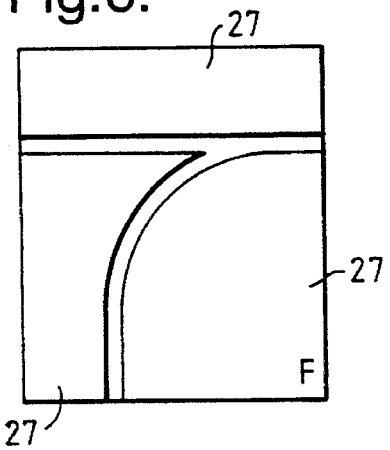

FIG. 6 illustrates a routing arrangement for use at the outlet of a rack and again comprises three plates 27 which define a horizontal, high level path as well as an arcuate path extending upwardly to connect with the high level horizontal path.

Figure 7:
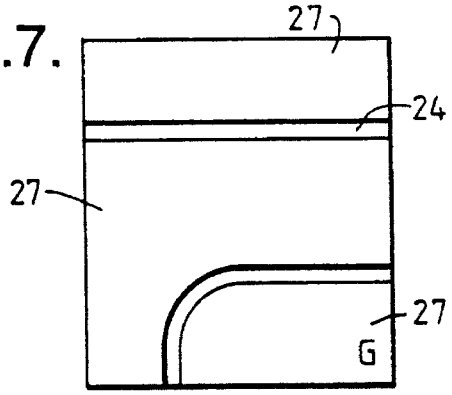

FIG. 7 illustrates a routing arrangement again for use at the outlet of a rack, this arrangement comprising three plates 27 which define a horizontal high level path and a separate, arcuate outlet path which extends upwardly and to one side to a low level outlet.

Figure 8:
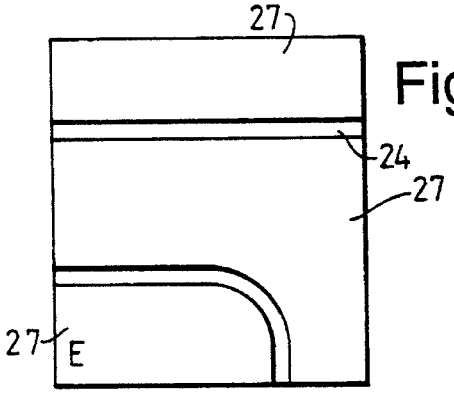

FIG. 8 shows a routing arrangement again comprising three plates 27, this arrangement being designed for use at the inlet to a rack and defining a horizontal high level path and a separate, arcuate path which extends inwardly and downwardly to provide an inlet to the rack from a low level.

Figure 9:
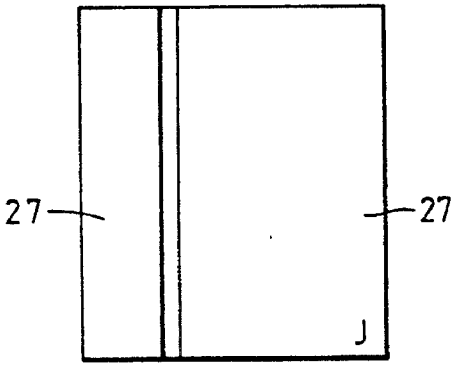

FIG. 9 shows a routing arrangement defined by two plates 27 which is intended for use in providing a vertical outlet from a rack. Thus the two plates serve to define a single, vertically extending channel or groove.

Referring once again to FIG. 1 of the accompanying drawings, it can be seen that various routing arrangements are provided at the corner regions 25,26 of each of the racks 7,8,9,10 in order to guide a strip of photographic film appropriately through the processing apparatus. Thus, the film will enter the apparatus at a high level and pass down into the first processing tank. As it leaves the first processing tank the film is routed up to a high level where it is conveyed horizontally along a path which bypasses the second processing tank. The film is then conveyed from a high level down into the third processing tank. Upon leaving the third processing tank the film remains at a low level and passes directly into the next processing tank which is the final tank shown in the arrangement illustrated. Upon leaving the final processing tank the film is guided vertically upwardly and can then be conveyed to the drying unit 6.

It is to be appreciated that the arrangement shown in FIG. 1 is purely for the purposes of illustration and, in practice, a processing apparatus may have a different number of processing tanks. However, it serves to show the way in which the appropriate selection of plates 27 enables a standard design of rack to be modified so as to provide a desired routing arrangement for a photographic film.

It is possible, for example, that the first and second processing tanks will contain two different types of developing solution, while the third and fourth tanks contain a photographic fixer and a washing solution. With minimal effort it would be possible to route different types of photographic film through the appropriate developing solution in either the first or the second processing tank, without the need in any way to modify the remainder of the apparatus.

In addition, the standard design of the basic rack enables maintenance personnel readily to replace one rack only should it become faulty and to install the appropriate plates 27 in order to ensure the correct routing of film passing through the apparatus. Maintenance personnel would therefore only need to carry a small number of replacement racks, together with a kit of plates 27 which would enable the assembly of a rack providing any desired routing arrangement. This represents a significant improvement over the situation where maintenance personnel need to carry a significant stock of racks which are of slightly different designs in order to provide for high level, low level or vertical entry or exit to or from a rack.

The plates 27 used to produce the routing arrangement at the inlet and outlet to each rack may be formed from any desired material and it is envisaged that the plates which engage the front and rear surfaces of the photographic film will be produced from different materials. Thus, if one considers the arrangement shown in FIG. 4, it is proposed that if the photographic film passes along this inlet groove 30 emulsion-side down, the small quadrant plate 27 will be formed of glass so that the gelatin on the film will travel freely across it. The larger plate 27 may be made of polytetrafluoroethylene or any other suitable plastics material. Depending upon the nature of the film which is being processed it would of course be possible to select other materials which are best suited for engaging the surfaces of the film so that the film will pass freely through the apparatus but will not be damaged. Indeed, as mentioned above, any of the plates 27 used in the routing arrangements can be formed from any desired material which is suitable for the purpose. Using separate plates to define the groove along which the film is conveyed as it passes from one processing solution to another makes it possible to use materials, such as glass, which could not easily have grooves machined in them. In contrast to the cutting of grooves in a single sheet of material using a small cutter, where the grooves are typically approximately 2 mm wide and 2 mm deep, the plates 27 which are used to define the guide path are easy and relatively inexpensive to produce. A robust cutter can be used for machining the edges of the plates which will define both the inside and the outside of the channel or groove along which the photographic film is conveyed. The arrangement also enables the plates to be dismantled and cleaned so as to remove crystalline deposits or oxidized chemicals which will tend to build up within the groove.

It will be appreciated that with the routing arrangements described above, it will be possible to assemble a single processing apparatus which can be used to process various types of photographic material, the single apparatus including processing tanks containing solutions to process any type of material with the material being routed through the appropriate solutions only. When the apparatus changes from processing one type of material to processing another type of material, it is merely necessary for certain of the plates 27 to be removed and replaced so that the next type of material to be processed is guided through the correct processing solutions. This is something which can be undertaken "in the field" and will only involve the processing apparatus being out of action for a minimal amount of time because it is not necessary to empty and recharge any of the processing tanks.

Although it is envisaged that the main benefit of the routing arrangement will be its use in order to vary the path which is followed by photographic film, it would of course be possible to use arrangements with replaceable plates at positions other than at the junction between adjacent racks. Thus, replaceable plates may be provided at positions along the entire path which is followed by the photographic film, both above and below the level of processing solution provided in the tank in which the rack is located. This would greatly facilitate the cleaning of the path along which the film is conveyed in contrast with existing arrangements where a single groove is milled in a single sheet of material and where the groove is relatively difficult to clean thoroughly.

While the invention has been described with reference to the processing of photographic material, it is to be appreciated that it can be utilized anywhere where a web-like item is guided along a path between various processing stations and where it may be necessary to vary that path from time to time.

It is to be understood that various changes and modifications may be made without departing from the scope of the present invention, the present invention being limited by the following claims.

PARTS LIST

1 . . . photographic processing apparatus
2,3,4,5 . . . processing tank
6 . . . drying unit
7,8,9,10 . . . rack
11,12 . . . wall
13,14 . . . grooves
15 . . . photographic film
16,17 . . . rollers
20,21 . . . opposed rollers
24 . . . groove or channel
25,26 . . . corner region
27 . . . plates
28 . . . screws
29 . . . supporting substrate
30 . . . groove
32 . . . track or channel

I claim:

1. A processing apparatus for processing a web-like item, said apparatus comprising a plurality of processing stations and means for conveying the web-like item through the apparatus along a predetermined path between the processing stations, the apparatus having opposed regions defining channels which receive opposed longitudinal edges of the web-like item, the channels defining said predetermined path, part of each channel being defined by elements releasably mountable upon the apparatus, the releasable mounting of the elements on the apparatus permitting ready removal of one set of elements and replacement by a different set of elements which define a different, predetermined path along which the web-like item is conveyed as it passes through the apparatus.

2. A processing apparatus according to claim 1, wherein said part of each channel is defined by the edges of plates constituting the said elements, the plates being releasably mounted upon a planar surface within said opposed regions of the apparatus.

3. A processing apparatus according to claim 2, wherein the plates are mounted directly upon the apparatus.

4. A processing apparatus according to claim 2, wherein the plates are mounted upon a supporting substrate which is in turn releasably mounted upon the apparatus.

5. A processing apparatus according to claim 2, wherein the plates on opposite sides of said part of the channel are formed of different materials.

6. A processing apparatus according to claim 5, wherein a first plate on one side of the channel is formed of glass and a second plate on the other side of the channel is formed of polytetrafluoroethylene.

7. A processing apparatus according to claim 1, wherein said part of the channels which are defined by elements releasably mounted upon the apparatus are disposed at the junction between adjacent processing stations, the arrangement being such that appropriate selection of the elements mounted upon the apparatus enables the predetermined path either to pass through a processing station or to bypass the processing station.

8. A processing apparatus according to claim 1, wherein the elements define two possible paths which may be followed by the web-like item and a switching arrangement is associated with the elements, the switching arrangement including a movable element which moves between two positions and establishes a route along a first path when in a first position and establishes a route along a second path when in a second position.

9. A processing apparatus according to claim 1, wherein the apparatus comprises a photographic processing apparatus.

10. A processing apparatus according to claim 1 in combination with a kit of said elements adapted to be releasably mounted on the apparatus, the kit comprising elements of differing shape which define different paths through the apparatus when mounted thereon.

* * * * *